United States Patent [19]

Herfeld

[11] 4,159,880

[45] Jul. 3, 1979

[54] CIRCULATION MIXER

[76] Inventor: Friedrich W. Herfeld, Wall 1, 5982 Neuenrade, Fed. Rep. of Germany

[21] Appl. No.: 898,116

[22] Filed: Apr. 20, 1978

[30] Foreign Application Priority Data

Apr. 22, 1977 [DE] Fed. Rep. of Germany ..... 2717887

[51] Int. Cl.[2] ..... B01F 5/12; B01F 15/02

[52] U.S. Cl. ..... 366/266; 366/163

[58] Field of Search ..... 366/266, 262, 263, 265, 366/241, 341, 347, 101, 163, 191

[56] References Cited

U.S. PATENT DOCUMENTS

| | | | |
|---|---|---|---|
| 2,530,814 | 11/1950 | Becze | 366/266 |
| 3,229,449 | 1/1966 | Hogue | 366/266 X |
| 3,339,897 | 9/1967 | Davis | 366/266 X |
| 4,002,325 | 1/1977 | Herfeld | 366/101 |

FOREIGN PATENT DOCUMENTS

| | | | |
|---|---|---|---|
| 1338172 | 8/1963 | France | 366/266 |

*Primary Examiner*—Edward J. McCarthy
*Attorney, Agent, or Firm*—Bacon & Thomas

[57] ABSTRACT

A supply chamber has an outlet for gravity feed of materials to be mixed to a mixing chamber in which a rotary mixing device is mounted. A conveying system continuously returns mixed materials from the mixing chamber to the supply chamber for recirculation and further blending. The conveying system may be in the form of a screw conveyor or an air stream that aspirates material from the mixing chamber.

8 Claims, 3 Drawing Figures

CIRCULATION MIXER

Figure 1:
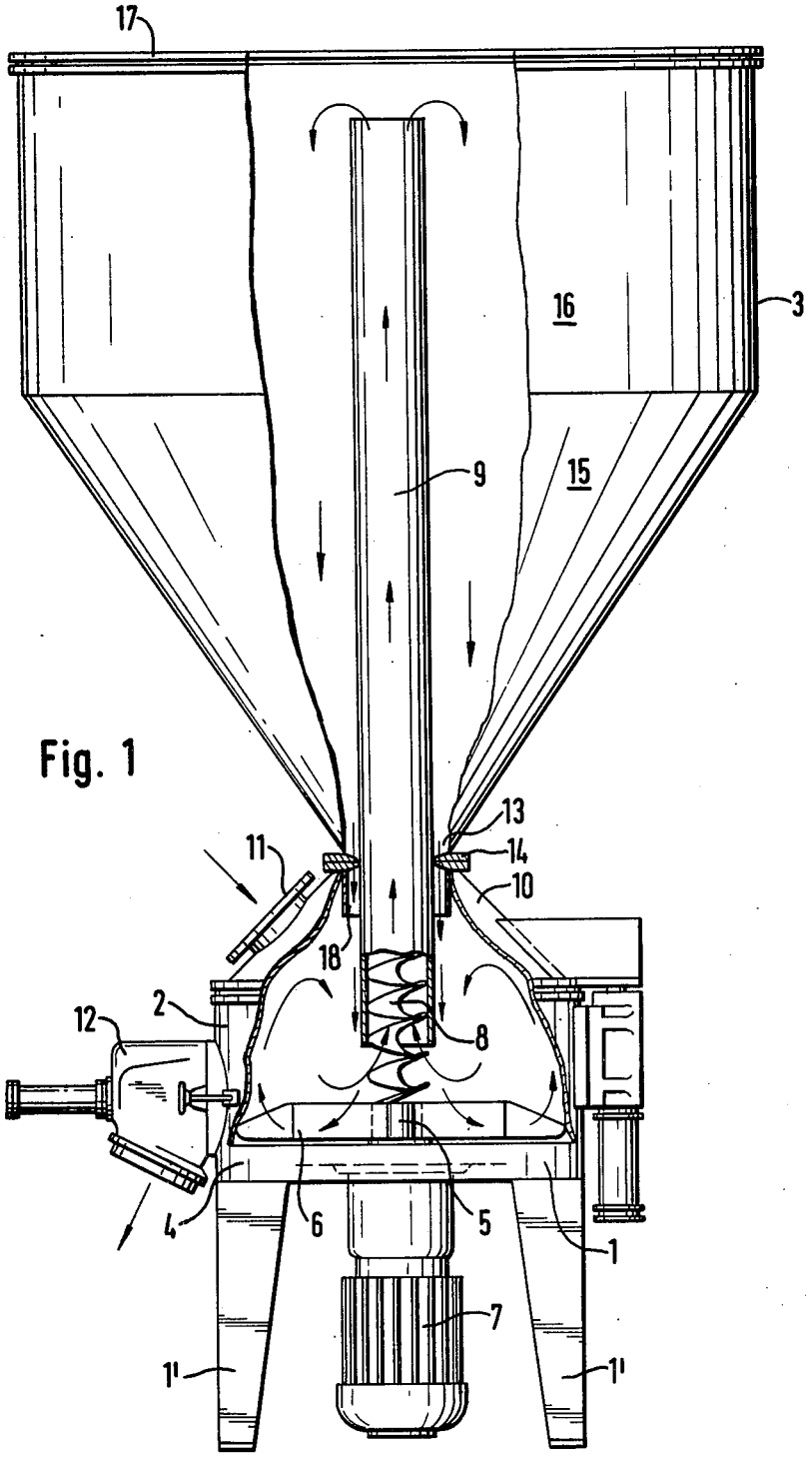

The invention relates to a circulation mixer, in the mixing container of which there is arranged a vertically extending mixing shaft, supporting a centrifugal mixing device.

The circulation mixer according to the invention serves for the mixing of dry materials or liquids.

Centrifugal mixers are known for their homogeneous mixing effect. However, there is just a limited capacity possibility. On the other hand, there are mixers for large charges, but the mixing action thereof is limited.

It is the object of the invention to provide a circulation mixer which secures even in the case of large charges an extremely homogeneous and finely distributed mixture.

This object is solved by the features as specified in claim 1.

The invention utilizes the intensive mixing effect of a centrifugal mixer. However, there is always just a small portion of the mixture within the centrifugal mixing container so that in each case merely such small portion of the total mixture is intensively mixed so that a fine distribution of the mixing components is achieved there. However, the portion of the total mixture present within the centrifugal mixing container is continuously exchanged for the mixture present within the head chamber. This exchange is performed continuously during the complete period of mixing. By the fact that one always mixes intensively just a small portion of the charge, it is achieved ultimately that one obtains an extremely fine distribution of the mixture components in the complete mixture. In this connection it is possible to do with a comparatively small centrifugal mixing instrument so that there will not occur an unsolvable problems of drive. The interchange of the mixture portion within the mixing container with the mixture within the head chamber is carried out continuously during the mixing operation by means of the transporting spiral device which continuously conveys a part of the contents of the mixing container. From the head chamber likewise a mixture portion continuously falls into the mixing container through the said connection.

Thus, the invention makes possible the preparing of a large charge, within which the individual components will be distributed uniformly and finely by the intense mixing of small portions.

By the provision of the connection as an annular gap, by a further development of the invention, a uniform feeding of the mixture portion into the mixing container is secured.

In order to be able to mix a charge as large as possible, the volume of the head chamber is substantially larger than that of the mixing container. The volume of the head chamber may be, e.g., ten times to a hundred times larger than the volume of the mixing container.

As a further development of the invention, it is provided that the annular gap can be closed, and that there is provided a feed opening in the side wall of the mixing container. By the closing of the annular gap it is possible to suppress the falling down of the mixture into the mixing container. In connection with the said feed opening it is then possible to fill the complete mixing container together with head chamber through this feed opening, the material to be mixed being conveyed into the head chamber via the transporting spiral device and the conveying pipe.

Figure 2:
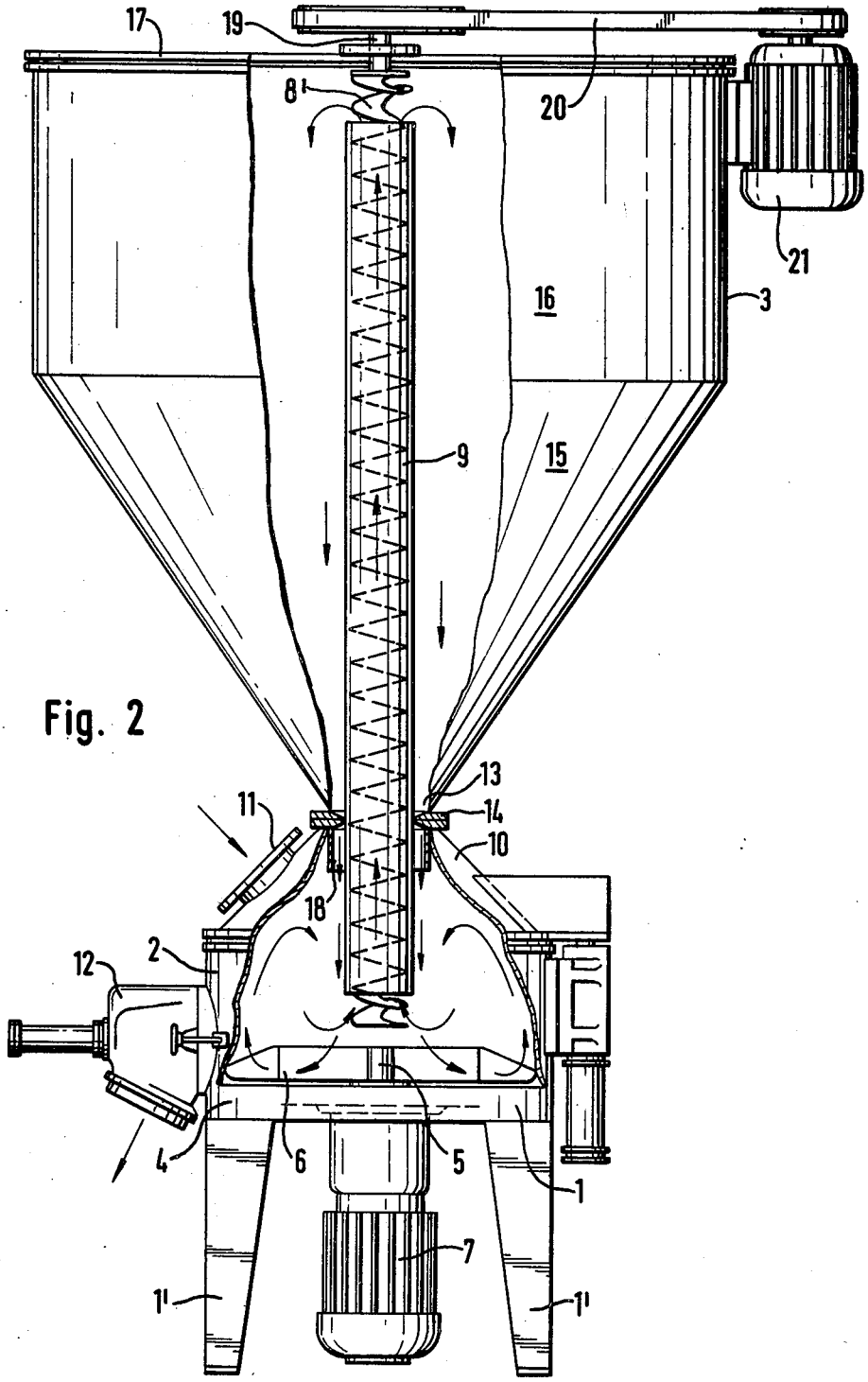
Figure 3:
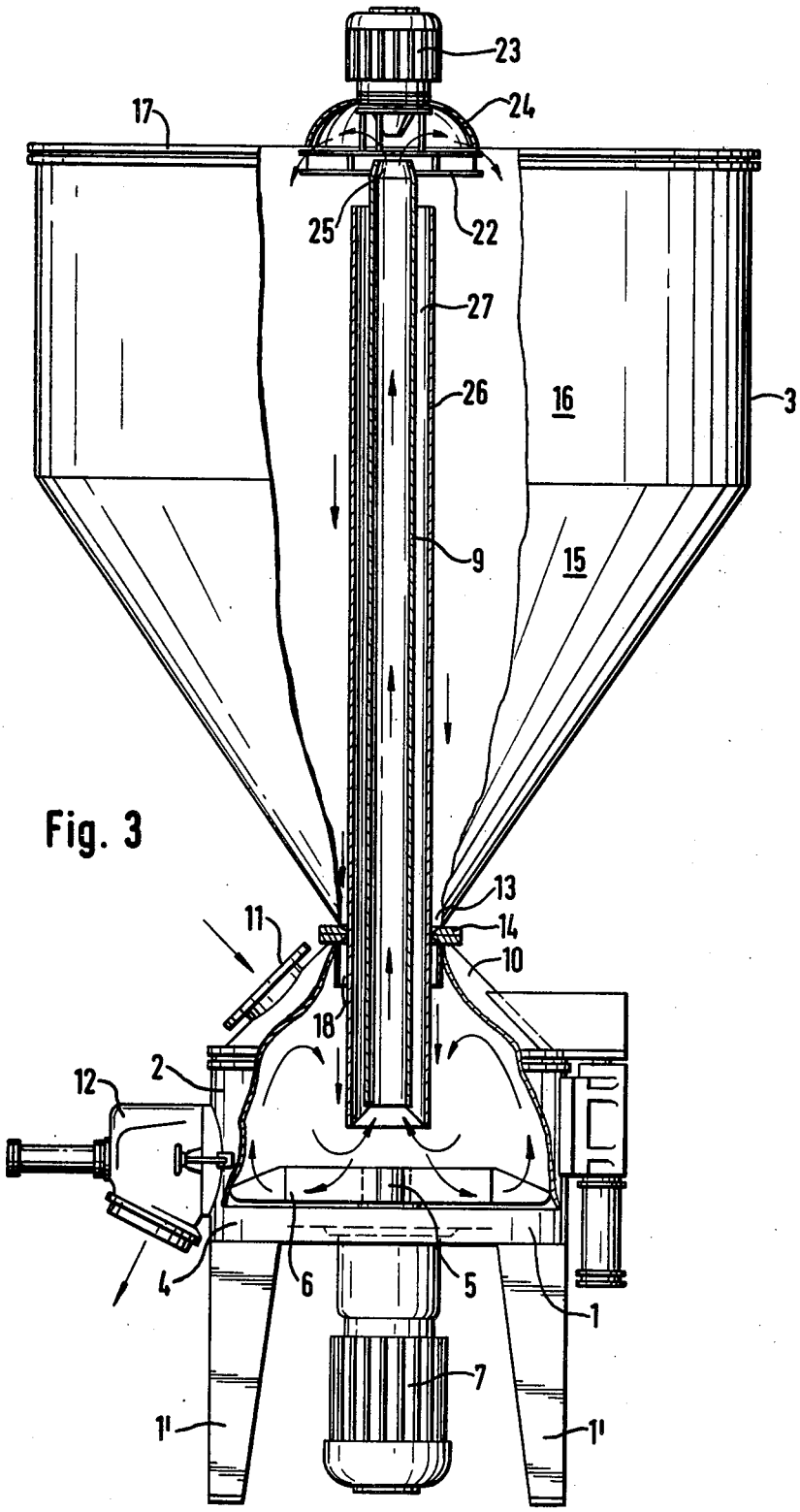

One embodiment of the invention will be described in the following with reference to the attached drawings, wherein:

FIG. 1 shows, as a diagrammatic view, a first embodiment of a circulation mixer according to the invention, partly broken away, FIG. 2 is an illustration of a modified embodiment of a circulation mixer, FIG. 3 is a view of a further embodiment of a circulation mixer.

The circulation mixer in accordance with FIG. 1 comprises a mixing container 1, supported on legs 1', having cylindrical or tapering side wall 2 and vertically extending container axis as well as a head chamber 3 above the mixing container 1. Through the bottom wall 4 of the mixing container 1 there is guided a mixing shaft 5 having a centrifugal mixing device 6. The mixing shaft 5 is driven by a motor 7. On the axle of the mixing shaft 5 there is mounted a transporting spiral device or screw conveyor 8 which projects into a vertically extending conveying pipe 9. Adjacent to the side wall 2 which may be provided cylindrical upwards in a tapering manner oı upwards in an expanding manner, there is provided a conical wall 10, in which there is provided a feed opening 11, having a closing device, not illustrated in detail. The side wall 2, the bottom wall 4, and the conical wall 10 may be equipped with cooling devices or heating devices. There is mounted an outlet slide 12 at the side wall 2.

The conveying pipe 9 extends through an opening between mixing container 1 and head chamber 3 in such a manner that an annular gap 13 remains free between conveying pipe and the interior edge of the opening. The annular gap 13 is fitted with a closing device 14. Upwards there is provided an expanding conical wall 15 and, finally, an annular wall 16 of the head chamber 3. The conveying pipe 9 extends almost to the top portion of the head chamber 3.

The head chamber 3 is closed by a cover 17. Adjacent the annular gap 13 there is provided a short down-pipe 18 directed downwards.

In operation, of the circulation mixer there is generated an intensive circulating movement within the mixing container 1 by means of the centrifugal mixing device 6, resulting in an intense mixing and a fine division of the components of the mixture. By means of the transporting spiral device 8 a part of the mixture is urged upwards within the conveying pipe 9 and enters the head chamber 3. According to the amount as conveyed upwards, the same amount of the mixture falls down through the annular gap 13 and the down-pipe 18 into the mixing container 1 and, thus, comes to the intensive mixing circulation. Consequently, gradually, progressively, and subsequently, the whole charge is intensively circulated within the mixing container 1.

The circulation mixer according to the present invention enables the intensive mixture of an extremely large charge. The head chamber 3 may comprise, e.g., a volume of 1,000 to more than 100,000 liters; the mixing container 1, e.g., a volume between 10 and 2,000 liters. On the one hand, the complete mixture is slowly circulated through the conveying pipe 9, the mixing effect thereof being low. However, always a small portion of the mixture is intensively and carefully mixed within the mixing container 1 so that therein a fine distribution of the mixing components is guaranteed. Thus, altogether a complete and intensive thorough mixing of the components within the complete large charge is achieved.

The closing device 14 renders possible a closing of the annular gap 13 in order to be able to fill the total circulation mixer with material to be mixed through the feed opening 11. The material to be mixed immediately enters the mixing container through the feed opening 11 and is conveyed by means of the transporting spiral device 8 within the conveying pipe 9 upwards into the head chamber 3. Due to the fact that the annular gap 13 is closed, it is not possible for the material to be mixed to fall down into the mixing container 1 from the head chamber 3. After conclusion of the filling operation, the feed opening 11 is closed, and the closing device 14 is opened again so that now material to be mixed may fall down from the head chamber 3 through the annular gap 13 into the mixing container 1 in compliance with the advance of the intensive mixing within the mixing container 1 and the conveyance of material to be mixed through the conveying pipe 9.

FIG. 2 shows a modified embodiment of the invention, according to which the transporting spiral device 8' is introduced into the conveying pipe 9 from the top and is also driven by a driving shaft 19, extending through the cover 17. The driving shaft 19 is driven via a belt drive 20 by a driving motor 21. The transporting spiral device 8' may be driven in this case independently of the mixing shaft 5, enabling additional modifications of the mixing process. It is possible to control the intensive mixing within the mixing container 1 and the interchange and the circulation of the material to be mixed within the head chamber 3 independently of one another. Thereby it is possible to adapt the mixing period individually to the properties of the specific mixture components.

FIG. 3 shows a further embodiment of the invention, wherein there is arranged, above the conveying pipe 9, a radial blower 22 which is driven by a motor 23. The motor 23 is mounted to a calot-shaped cap 24 of the cover 17 and extends through this cap 24 with its drive shaft. The conveying pipe 9 extends by a slightly tapering mouth 25 up to the center of the radial blower 22. A tubular shell 26 surrounds the conveying pipe 9 from the lower end thereof to a level which extends beyond the filling level of the head chamber 3. Consequently, there is provided an annular gap 27 between the tubular shell 26 and the conveying pipe 9. In operation, the radial blower 22 generates an underpressure at the mouth 25 of the conveying pipe so that thereby air and, thus, also parts of the material to be mixed will be conveyed. The parts of the material to be mixed are moved in the direction of the arrows through the interior space of the cap 24 and fall down from top into the head chamber 3. Through the annular gap 27, air can stream in an unobstructed manner to the bottom of the conveying pipe 9 so that there is secured a permanent conveying stream.

I claim:

1. A circulation mixer comprising:

means defining a mixing chamber;

a central vertical rotary shaft in said chamber and having a centrifugal mixing device thereon;

a supply chamber above said mixing chamber and having an outlet opening communicating with said mixing chamber;

a conveying pipe extending from said mixing chamber into said supply chamber through said outlet opening substantially coaxial to said shaft, there being an annular space between said conveying pipe and said outlet opening; and means for circulating mixed materials from said mixing chamber, through said conveying pipe, to said supply chamber.

2. A mixer as defined in claim 1 wherein said last-named means is a screw conveyor connected to said shaft and extending upwardly through said conveyor pipe.

3. A mixer as defined in claim 1 wherein said last-named means is a screw conveyor extending through said conveyor pipe, and drive means for rotating said screw conveyor from the upper end thereof.

4. A mixer as defined in claim 1 wherein said last-named means is a suction device arranged to draw air from said mixing chamber, through said conveyor pipe, into said supply chamber.

5. A mixer as defined in claim 4 including a tube surrounding said conveyor pipe, in spaced relation thereto and spaced from the sides of said outlet opening, for return of air from said supply chamber to said mixing chamber.

6. A mixer as defined in claim 1 wherein the volume of said supply chamber is several times the volume of said mixing chamber.

7. A mixer as defined in claim 1 including selectively operable means for closing said annular space.

8. A mixer as defined in claim 7 including means for initially feeding materials to be mixed directly into said mixing chamber from the exterior of said circulation mixer.

* * * * *